United States Patent [19]

Hawker et al.

[11] Patent Number: 4,806,390

[45] Date of Patent: Feb. 21, 1989

[54] MASKING COMPOSITIONS FOR CHEMICAL MILLING AND METHOD FOR APPLYING THE SAME

[75] Inventors: Fred D. Hawker, Villa Park; Victor E. Pietryga, Berwyn; Robert W. Byrd, Algonquin, all of Ill.

[73] Assignee: DeSoto, Inc., Des Plaines, Ill.

[21] Appl. No.: 108,430

[22] Filed: Oct. 14, 1987

[51] Int. Cl.[4] ..... B65B 33/00; B05D 1/18; B05D 1/36; B05D 3/02

[52] U.S. Cl. ..... 427/156; 427/259; 427/327; 427/388.4; 427/409; 427/435; 524/446; 524/519

[58] Field of Search ..... 427/327, 409, 388.4, 427/435, 156, 259; 524/446, 519

[56] References Cited

U.S. PATENT DOCUMENTS 4,191,676 3/1980 Hall ..... 427/435 X
4,373,050 2/1983 Steinbrecker et al. ..... 427/435 X

FOREIGN PATENT DOCUMENTS 2540068 4/1976 Fed. Rep. of Germany ..... 427/435
1498144 1/1978 United Kingdom .

*Primary Examiner*—Michael Lusignan
*Attorney, Agent, or Firm*—Dressler, Goldsmith, Shore, Sutker & Milnamow, Ltd.

[57] ABSTRACT

A method of coating a metal part with a peelable mask which is resistant to attack by the strong acid and strong base etchants used in chemical milling is disclosed in which the metal part is surfaced with a layer of polyvalent metal salt, such as calcium nitrate, and then immersed in a high solids content anionic emulsion of coalescent rubbery particles heavily pigmented to contain at least about 45% total solids content and at least 20% pigment, the pigment to binder ratio being from 0.75:1 to 1:0.51. The salt-surfaced metal part is held in the anionic emulsion until the desired coating thickness has been anodically deposited thereon, and then the coated part is removed and baked to complete the formation of the mask. The rubbery particles are preferably constituted by an anionic polychloroprene homopolymer emulsion which is used in admixture with a curing agent for the homopolymer, like zinc oxide, and a polyvinylidene chloride latex. Sodium bichromate is included with the polyvalent metal salt to enhance corrosion resistance, and a silicone release agent is included to control adhesion to the metal substrate.

20 Claims, No Drawings

MASKING COMPOSITIONS FOR CHEMICAL MILLING AND METHOD FOR APPLYING THE SAME

TECHNICAL FIELD

This invention relates to aqueous masking compositions which are used in chemical milling processes, and includes the method of applying the masking compositions to metal articles to be milled.

BACKGROUND ART

Chemical milling in which strong acids or alkalis are used to etch away unneeded portions of a metal article is well known, especially in the aircraft industry where it is used to reduce the weight of aircraft parts. In the known process, a polymeric masking which resists the etching bath used is applied directly to the metal substrate, as by dipping. The applied mask is then scribed (cut through to base metal) using an appropriate template to allow desired portions of the applied mask to be peeled away to selectively expose those portions of the metal which it is desired to etch.

The character of the etching composition (etchant) will vary with the metal of the substrate. To illustrate this, an alkali bath is used to etch aluminum parts, and an acid bath is used to etch titanium parts. The rate at which the exposed metal is removed by the etchant will vary with its concentration and its temperature.

When the etching (chemical milling) process has been completed, the remaining mask is removed, and the etched part is appropriately rinsed, deoxidized if appropriate, and dried. In practice several dipping and drying steps are required to apply an appropriate mask, ready for scribing.

The normal masking composition used by most aircraft manufacturers today are rubber elastomers dissolved in organic solvents, such as toluene/xylene or perchloroethylene, the latter solvent being frequently employed because of its effectiveness. The coating systems which are in use are low solids content systems containing a high proportion of volatile organic solvent. The masking compositions are applied in two to three dipping operations in which the panel is dipped in the composition, excess material is dripped off, and the remainder is dried, usually in an oven. This process is then repeated until an appropriate mask thickness has been built up. A commonly used process is outlined below:

1. Apply first coat
2. Bake at 100° F. for 45 minutes
3. Bake at 150° F. for 45 minutes
4. Cool
5. Rotate the part "top for bottom"
6. Apply second coat
7. Bake at 100° F. for 45 minutes
8. Bake at 150° F. for 45 minutes
9. Remove large aluminum part
10. Leave on conveyor all extrusion, true trim parts, parts shorter than eighteen inches.
11. Apply third coat for parts left in Step 10
12. Bake at 100° F. for 45 minutes
13. Bake at 150° F. for 45 minutes
14. Remove parts left in Step 10
15. Rack masked titanium parts on separate rack
16. Bake titanium at 225° F. in separate oven
17. Remove titanium parts The solvents used in these systems are not exempt and must be considered as volatile organic content (VOC). Because of the low solids content of the organic solvent system used to apply the mask, the VOC of most of the systems is as high as 1200 grams per liter.

One method to reduce the VOC of the masking system is to use solvent recovery to reclaim most of the solvent emitted during the mask application process. Solvent recovery systems add complexity and expense.

Some aircraft manufacturers are currently using a solvent recovery system in conjunction with the use of perchloroethylene as the solvent in the masking solution. The entire coating system is enclosed, solvent being recovered from both the dipping and baking areas. The current efficiency of this system is 91%. The solvent is collected and used as a reducer in the masking solution without reprocessing.

The expense of building and operating such a system is obvious, leakage reduces its efficiency, and some perchloroethylene is retained in the mask film to be released in subsequent processing. Perchloroethylene presents a known carcinogenic risk which it is desired to avoid.

DESCRIPTION OF INVENTION

In accordance with this invention, a metal part to be coated is surfaced with a layer of polyvalent metal salt and immersed in a high solids content anionic emulsion of coalescent rubbery particles heavily pigmented to contain at least 20% pigment and having a pigment to binder ratio of from 0.75:1 to 1:0.57. The salt-surfaced metal part is held in the anionic emulsion until the desired coating thickness has been deposited thereon, rinsed if desired, and then removed and baked to complete the formation of the mask. This mask is desirably overcoated with a latex seal coat to insure a complete seal of the metal surface.

All parts and proportions herein and in the accompanying claims are by weight, unless otherwise specified.

As will be evident, many of the problems of the prior art solvent solution systems are eliminated. Thus, the anode deposition process of this invention contains no organic solvent (or very little), the required thick films are directly deposited in a single application, and the drip removal of excess masking solution is no longer needed.

Referring more particularly to the anodic deposition process under consideration, the part to be masked is first coated with a thin layer of a multivalent salt to act as a coagulant for the anodic latex. This is conveniently accomplished by dipping the part in water in which the multivalent salt has been dissolved and then drying the part after its removal from the aqueous salt solution. Many multivalent salts are known for use in anionic depositions processes, and any of these may be used herein. This component is illustrated by calcium nitrate, albeit zinc chloride is also an effective multivalent salt to coagulate the anionic latex.

It is desired to stress that the multivalent salt and its application in aqueous medium to an object to be coated with an anionic emulsion are themselves well known and do not constitute the essence of what has been contributed herein.

The part with the dried multivalent salt on its surface is then dipped into the pigmented anionic latex and held until the desired film thickness has been deposited. An appropriate thickness is from 0.008 to 0.020 inch, preferably 0.010 to 0.012 inch, and it is deposited herein in less than two minutes.

The latex-coated part is then removed from the anionic latex bath and usually rinsed, as by dipping it into an aqueous rinse solution to remove excess latex before drying and baking the coated part. The rinse operation is not always necessary.

An addition latex seal coat is usually applied as a precaution to insure a complete seal of the metal surface, but this seal coat is quite thin, being normally less than two mils in thickness. The seal coat may be applied by conventional dipping.

The anionic emulsion of rubbery particles may be any rubbery polymer providing resistance to the strong acids and strong bases which are used as etchants. These emulsions are prepared by producing the rubbery polymer in an aqueous anionic colloidal system, but this is itself well known. We prefer to use an anionic Neoprene resin latex supplied by du Pont under the trade designation 842A. Neoprene is a polychloroprene homopolymer.

Neoprene is preferred because of its outstanding resistance to strong acids and bases, but other rubbery polymers in the form of an aqueous anionic latex may be used instead, such as natural rubbers and nitrile rubbers.

To add strength and toughness, a polyvinylidene chloride emulsion is added, such as Daran 143, (0.5% to 5% based on the Neoprene).

A curing agent is added to the anionic latex emulsion to cure the rubbery polymer, and these and their proportion of use are well known. We prefer to use zinc oxide, but magnesium oxide is also effective.

The significant point about the aqueous masking composition is that the anionic latex is formulated to have a total solids content of at least about 45%, preferably at least 55%, to minimize the water present, and it is pigmented to a high pigment content, as previously defined. This is necessary in order that the mask which is formed will rapidly and uniformly deposit to required thickness and deposit a coating which does not pull away from the edges of the part being masked. The heavy pigmentation further insures that the deposited film will not be fluffy. Finely divided neutral clay is a preferred pigment, and it may be extended with aluminum silicate calcium carbonate, silica or the like.

The aqueous masking emulsion is usually formulated with deionized water, and it will also contain ancillary agents for ancillary purposes. These are illustrated by: antioxidants, such as 2,2-methylenebis(4-methyl-6-tertiary butyl phenyl)methane, chelating agents, such as ethylene diamine tetraacetic acid, anti-foaming agents, such as Drewplus L475, colorants such as phthalo blue colorant, surfactants such as the sodium soap of a modified rosin, illustrated by Dresinate 731, as well as glycine to help control the pH of the aqueous medium.

The aqueous coagulant bath in this invention also includes a soluble chromate pigment, such as sodium bichromate, to enhance corrosion resistance, a surfactant to insure wetting the substrate, and a silicone release agent to control the adhesion of the anodically deposited mask film to the metal substrate to help insure that it will peel away easily and completely when this is desired.

An illustrative masking composition is as follows.

| Component | Parts by Wt. |
|---|---|
| 1 Anionic rubbery latex (note 1) | 46 |

-continued

| Component | Parts by Wt. |
|---|---|
| 2 Polyvinylidene chloride latex (note 2) | 1.1 |
| 3 Zinc oxide | 2.5 |
| 4 Clay (note 3) | 48 |
| 5 Antifoaming agent (note 4) | 0.5 |
| 6 Antioxidant (note 5) | 0.8 |
| 7 Chelating agent (note 6) | 0.05 |
| 8 Surfactant (note 7) | 1.00 |
| 9 Glycine | to adjust pH |

Note 1 - the du Pont product Neoprene 842A may be used.
Note 2 - Daran 143 available from W. R. Grace & Co. New York, NY may be used
Note 3 - ASP 602, a finely divided neutral clay available from Englehart Chemical Company of Menlo Park, NJ may be used.
Note 4 - Drewplus L475 available from Drew Chemical Corporation, Boonton, NJ may be used.
Note 5 - 2,2-methylenebis (4-methyl-6-tertiary butyl phenyl) methane
Note 6 - tetrasodium salt of ethylene diamine tetraacetic acid
Note 7 - sodium salt of an anionic surfactant, such as Dresinate 731 from Hercules, Wilmington, DE may be used.

It is desired to point out that components 5, 6, 7 and 9 are optional components and are used for best performance, but they are not essential.

Unlike conventional practice of incorporating the pigment into the water and then adding the other materials, all of the above are combined and mixed together at the same time. This minimizes the water content and helps to provide the high total solids content which is desired. In this case the total solids content is 64% and the pigment content is 33%. The usual pH is in the range of 9–11.

While it is preferred to achieve high solids content using the mixing procedure specified above, this is not essential, and under appropriate conditions one can minimize the water content in other ways.

The above masking composition will adhere to metal substrates somewhat more strongly than desired, and this makes it difficult to obtain a clean peel. It is desired to have a peel strength of 10–20 inch pounds per linear inch. High peel strength can be tolerated, or it can be reduced by adding a silicon release agent to the coagulant solution. The silicone release agent (30% solids in water) is used in an amount of from 0.5–3 pounds per 100 gallons of coagulant solution containing about 200–400 pounds of calcium nitrate. A preferred coagulant solution will further include about 10 pounds per 100 gallons of a soluble chromate pigment, such as sodium bichromate. The coagulant solution is preferably applied to the part hot, e.g., at a temperature of about 60° C.

In typical operation, the aqueous coagulant solution contains, per 100 gallons of solution, 300 pounds of calcium nitrate, 2 pounds silicone release agent, 10 pounds of sodium bichromate and 1% of a nonionic surfactant to aid wetting (Igepal CA-630 produced by GAF Corporation, NY, NY may be used). It is heated to 60° C. and aluminum parts are immersed therein for a period of 45 to 60 seconds. The wet parts are then force dried at 60° C.–80° C. for 5 to 10 minutes.

Promptly after drying (to minimize moisture pick-up) the room temperature, salt-surfaced, dried parts are immersed in the previously described masking emulsion which contains enough glycine for a pH of 10.3. After a one minute immersion in the masking emulsion at room temperature, the anionic deposition process deposits a coating having a dry thickness of 10–14 mils. The coated parts are then air dried for 10 minutes and cured for 1 hour at 190° F.

If desired, these cured parts can have a seal coat applied and baked thereon. This involves dipping in a dilute aqueous latex, air drying for 30 minutes and then baking for 30 minutes at 240° F. If no seal coat is applied, the mask is baked under the same baking schedule. A 90% vinylidene chloride/10% butyl acrylate copolymer latex (Polidene 33-004 available from Pacific Scott Bader Inc., Richmond, CA) may be used for the seal coat, but other latices and aqueous dispersions are also useful, such as the latex product containing styrene-butadiene copolymer available under the trade designation Tylac 68-010 from Reichhold Chemical Co., Elizabeth NJ.

It will be appreciated that the use of an aqueous emulsion-type sealer avoids the large amounts of difficult volatile organic solvents which are usually needed.

What is claimed is:

1. A method of coating a metal part with a peelable mask which is resistant to attack by the strong acid and strong base etchants used in chemical milling comprising surfacing said metal part with a layer of polyvalent metal salt, immersing said salt-surfaced metal part in a high solids content anionic emulsion of coalescent rubbery particles heavily pigmented to contain at least about 45% total solids content and at least 20% pigment, the pigment to binder ratio being from 0.75:1 to 1:0.57, holding said salt-surfaced metal part in said anionic emulsion until the desired coating thickness has been anodically deposited thereon, and then removing and baking the coated part to complete the formation of the mask.

2. A method as recited in claim 1 in which the coated part removed from said anionic emulsion is rinsed prior to baking.

3. A method as recited in claim 1 in which said metal part is surfaced with said layer of polyvalent metal salt by immersing said part in an aqueous solution of said salt, and then removing said part and drying the same.

4. A method as recited in claim 1 in which said polyvalent metal salt is calcium nitrate.

5. A method as recited in claim 1 in which said coating thickness is in the range of from 0.008 inch to 0.020 inch.

6. A method as recited in claim 1 in which said coating thickness is in the range of from 0.010 inch to 0.012 inch.

7. A method as recited in claim 1 in which said baked coated part is overcoated with a latex seal coat.

8. A method as recited in claim 1 in which said latex seal coat is less than two mils in thickness.

9. A method as recited in claim 1 in which said anionic emulsion of coalescent rubbery particles comprises an anionic polychloroprene homopolymer.

10. A method as recited in claim 9 in which said anionic emulsion further comprises 0.5% to 5% of a polyvinylidene chloride emulsion based on said polychloroprene homopolymer.

11. A method as recited in claim 1 in which said anionic emulsion is pigmented with finely divided clay.

12. A method as recited in claim 10 in which said anionic emulsion is pigmented with finely divided clay.

13. A method as recited in claim 1 in which said anionic emulsion includes a curing agent for said rubbery material.

14. A method as recited in claim 13 in which said curing agent is zinc oxide.

15. A method as recited in claim 1 in which said anionic emulsion of coalescent rubbery particles is pigmented to contain at least about 55% total solids content.

16. A method as recited in claim 15 in which said anionic emulsion of coalescent rubbery particles comprises an anionic polychloroprene homopolymer in admixture with a polyvinylidene chloride latex and finely divided clay.

17. A method as recited in claim 1 in which said metal part is surfaced with said layer of polyvalent metal salt by immersing said part in an aqueous solution of said salt containing sodium bichromate to enhance corrosion resistance, and then removing said part and drying the same.

18. A method as recited in claim 1 in which said metal part is surfaced with said layer of polyvalent metal salt by immersing said part in an aqueous solution of said salt containing a silicone release agent to control the adhesion of the anodically deposited mask to the metal substrate.

19. A method as recited in claim 17 in which said metal part is surfaced with a layer of calcium nitrate by immersing said part in an aqueous solution thereof containing sodium bichromate.

20. A method as recited in claim 1 in which said anionic emulsion of coalescent rubbery particles has a pH in the range of 9–11.

* * * * *